US011686277B2

(12) United States Patent
Dudar

(10) Patent No.: US 11,686,277 B2
(45) Date of Patent: Jun. 27, 2023

(54) DIAGNOSTIC FOR A FUEL SYSTEM

(71) Applicant: FORD GLOBAL TECHNOLOGIES, LLC, Dearborn, MI (US)

(72) Inventor: Aed M Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/376,862

(22) Filed: Jul. 15, 2021

(65) Prior Publication Data

US 2023/0014329 A1 Jan. 19, 2023

(51) Int. Cl.
*F02M 25/08* (2006.01)

(52) U.S. Cl.
CPC ..... *F02M 25/0827* (2013.01); *F02M 25/089* (2013.01); *F02M 25/0836* (2013.01); *F02M 25/0854* (2013.01)

(58) Field of Classification Search
CPC ..... F02M 25/0827; F02M 25/0836; F02M 25/0854; F02M 25/089
See application file for complete search history.

(56) References Cited

U.S. PATENT DOCUMENTS 5,893,353 A * 4/1999 Mukai ..... F02M 25/08 123/520
9,512,791 B1 12/2016 Dudar et al.
9,669,705 B2 6/2017 Pearce et al.
9,790,874 B2 10/2017 Dudar
10,393,071 B2 * 8/2019 Dudar ..... F02M 25/0854
10,598,134 B1 * 3/2020 Dudar ..... F02M 26/48
10,697,399 B2 6/2020 Choi
10,975,782 B2 4/2021 Dudar et al.
2001/0011539 A1 * 8/2001 Ito ..... F02M 25/032 123/518
2004/0173190 A1 * 9/2004 Makino ..... F02M 25/0836 123/520
2007/0295307 A1 * 12/2007 Kerns ..... F02D 35/027 123/445
2015/0122229 A1 * 5/2015 Dudar ..... F16K 37/0041 73/114.38
2016/0305352 A1 * 10/2016 Pursifull ..... F02D 41/0045
2016/0341155 A1 * 11/2016 Dudar ..... F02D 41/0007
2017/0276078 A1 * 9/2017 Imaizumi ..... F02M 25/089
2019/0285018 A1 * 9/2019 Dudar ..... F02M 35/024
2019/0383246 A1 * 12/2019 Dudar ..... F02M 26/10

* cited by examiner

*Primary Examiner* — Hung Q Nguyen
*Assistant Examiner* — Susan E Scharpf
(74) *Attorney, Agent, or Firm* — Vincent Mastrogiacomo; Brooks Kushman P.C.

(57) ABSTRACT

A vehicle includes an engine, a fuel tank, a primary canister, a buffer canister, a purge valve, a check valve, and a controller. The fuel tank is configured to store fuel. The primary canister is configured to receive and store evaporated fuel from the fuel tank. The buffer canister is configured to receive and store the evaporated fuel from the fuel tank. The buffer canister is disposed between the primary canister and the engine. The purge valve is disposed between the buffer canister and the engine. The purge valve is configured to direct the evaporated fuel from the primary and buffer canisters to the engine when open. The check valve is disposed between the primary and buffer canisters and is configured to restrict backflow of the evaporated fuel from the buffer canister toward the primary canister. The controller is programmed to diagnose the operability of the check valve.

12 Claims, 5 Drawing Sheets

DIAGNOSTIC FOR A FUEL SYSTEM

TECHNICAL FIELD

The present discloser relates to fuel systems for vehicles.

BACKGROUND

Vehicles may include fuel systems that are configured to deliver fuel from a fuel tank to an internal combustion engine.

SUMMARY

A vehicle includes an engine, a fuel tank, a first canister, a second canister, a check valve, and a controller. The fuel tank is configured to store fuel. The first and second canisters are each configured to receive evaporated fuel from the fuel tank, store the evaporated fuel, and deliver the evaporated fuel to the engine. The second canister is disposed between the first canister and the engine. The check valve is disposed between the first and second canisters and is configured to restrict backflow of the evaporated fuel from the second canister toward the first canister. The controller is programmed to, in response to detecting a rich value of an air-to-fuel ratio of the engine in less than a predetermined period of time after an engine start, output a fault signal indicating that the check valve is unable to close.

A vehicle includes an engine, an oxygen sensor, a fuel tank, a primary canister, a secondary canister, a check valve, a pressure sensor, and a controller. The engine is configured to propel the vehicle. The oxygen sensor is configured to measure an oxygen content within an exhaust output of the engine. The fuel tank is configured to store fuel. The primary canister is configured to receive evaporated fuel from the fuel tank, store the evaporated fuel via adsorption, and deliver the evaporated fuel to the engine via desorption. The secondary canister is disposed between the primary canister and the engine. The secondary canister is configured to receive the evaporated fuel from the fuel tank, store the evaporated fuel via adsorption, and deliver the evaporated fuel to the engine via desorption. The check valve is disposed between the primary and secondary canisters. The check valve is configured to facilitate flow of the evaporated fuel from the primary canister to the secondary canister. The check valve is also configured to restrict flow of the evaporated fuel from the secondary canister to the primary canister. The pressure sensor is disposed between the primary canister and the fuel tank. The pressure sensor is configured to measure a pressure of the evaporated fuel. The controller is programmed to, determine an air-to-fuel ratio of the engine based on the measured oxygen content within the exhaust output of the engine. The controller is further programmed to, in response to a cold engine start and the air-to-fuel ratio transitioning to a rich value in less than a predetermined period of time after the cold engine start, output a signal that the check valve is unable to close. The controller is further programmed to, in response to the cold engine start and the pressure sensor registering a pressure value that is greater than a threshold, output a signal that the check valve is unable to open. The controller is further programmed to, in response to the air-to-fuel ratio transitioning from a lean value to the rich value after the predetermined period of time has expired, and the pressure sensor registering the pressure value being less than the threshold, output a signal indicating that the check valve is operating properly.

A vehicle includes an engine, a fuel tank, a primary canister, a buffer canister, a purge valve, a check valve, and a controller. The fuel tank is configured to store fuel. The primary canister is configured to receive and store evaporated fuel from the fuel tank. The buffer canister is configured to receive and store the evaporated fuel from the fuel tank. The buffer canister is disposed between the primary canister and the engine. The purge valve is disposed between the buffer canister and the engine. The purge valve is configured to direct the evaporated fuel from the primary and buffer canisters to the engine when open. The check valve is disposed between the primary and buffer canisters and is configured to restrict backflow of the evaporated fuel from the buffer canister toward the primary canister. The controller programmed to, in response to an engine start, open the purge valve and monitor a pressure of the evaporated fuel. The controller is further programmed to, in response to the pressure of the evaporated fuel being greater than a threshold, output a signal that the check valve is unable to open.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
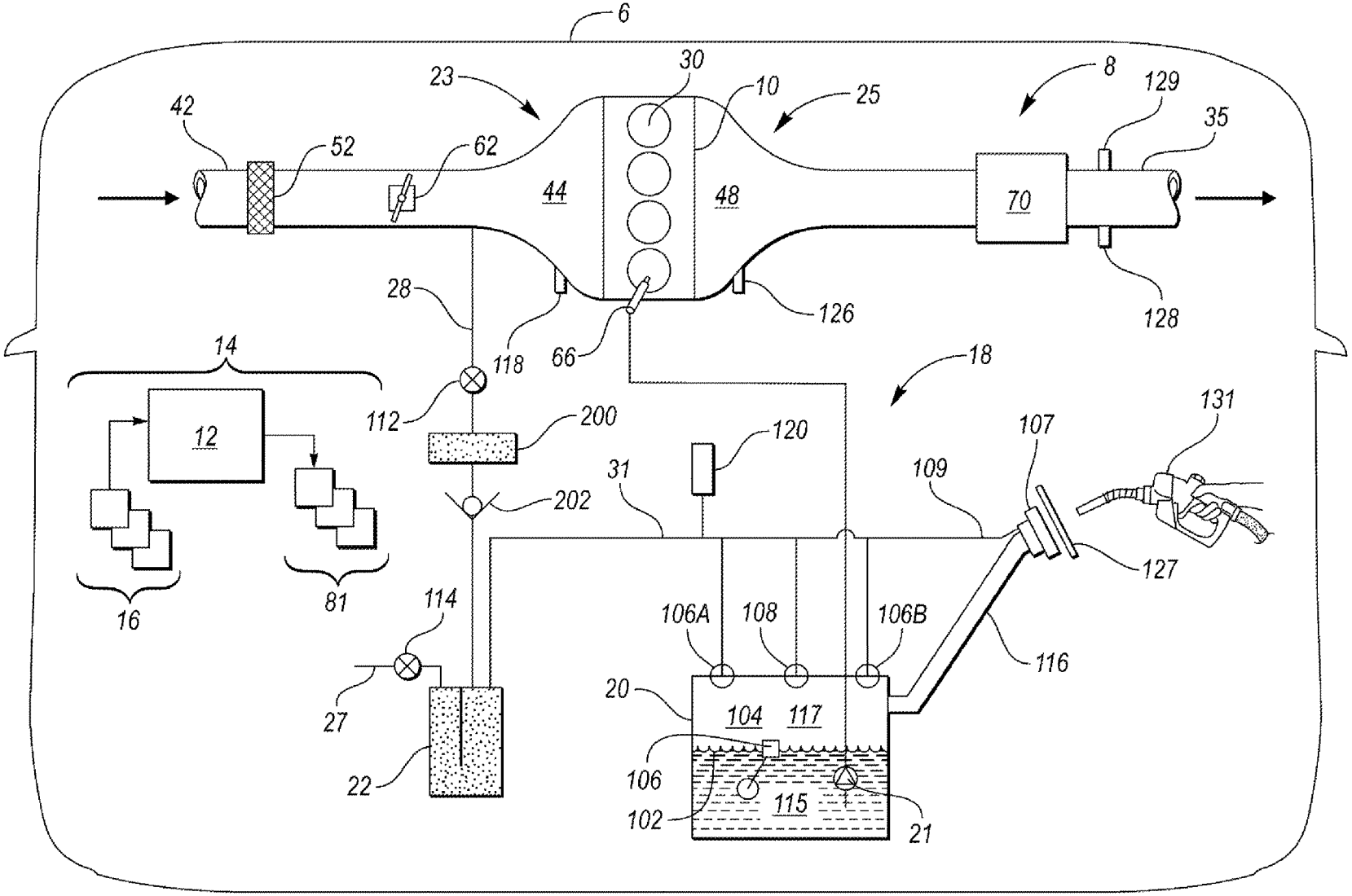
FIG. 1 is a schematic illustration of a vehicle and a fuel system for the vehicle.

FIG. 1 shows a schematic depiction of a vehicle 6, an engine system 8, and a fuel system 18. The fuel system 18 may more specifically be a fuel delivery system for an engine 10. The vehicle 6 may be a hybrid vehicle, such as a hybrid electric vehicle. A hybrid electric vehicle may derive propulsion power from the engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device. Alternatively, the vehicle 6 may be a non-hybrid vehicle, such as a conventional internal combustion engine vehicle.

Engine system 8 may include an engine 10 having a plurality of cylinders 30.

Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices 70 may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

When configured as a hybrid vehicle, the vehicle may be operated in various modes. The various modes may include a full hybrid mode or battery mode, wherein the vehicle is driven by power from only the battery. The various modes may further include an engine mode wherein the vehicle is propelled with power derived only from the combusting engine. Further, the vehicle may be operated in an assist or mild hybrid mode wherein the engine is the primary source of torque and the battery selectively adds torque during specific conditions, such as during a tip-in event. A controller may shift vehicle operation between the various modes of operation based at least on vehicle torque/power requirements and the battery's state of charge. For example, when the power demand is higher, the engine mode may be used to provide the primary source of energy with the battery used selectively during power demand spikes. In comparison, when the power demand is lower and while the battery is sufficiently charged, the vehicle may be operated in the battery mode to improve vehicle fuel economy. Further, as elaborated herein, during conditions when a fuel tank vacuum level is elevated, the vehicle may be shifted from the engine mode of operation to the battery mode of operation to enable excess fuel tank vacuum to be vented to the engine's intake manifold without causing air-fuel ratio disturbances.

Engine system 8 is coupled to the fuel system 18. Fuel system 18 includes a fuel tank 20 coupled to a fuel pump 21, a first or primary fuel vapor storage device or canister 22, and a second or secondary fuel vapor storage device or canister 200. The second fuel vapor canister 200 may also be referred to as the buffer fuel vapor canister and is configured to provide additional storage space for when the first fuel vapor canister 22 has no further capacity to store fuel vapors. The fuel tank 20 supplies fuel to the engine 10 which propels a vehicle 6. The first canister 22 and the second canister 200 are subcomponents of and evaporative emissions system that prevents fuel vapors from being released into the environment. The first canister 22 and the second canister 200 are separated by a one-way check valve 202. One-way check valve 202 is depicted as a vacuum-actuated check valve. However, in other examples the check valve 202 may comprise a solenoid valve wherein opening or closing the valve is performed via actuation of a check valve solenoid. The check valve 202 is configured to facilitate flow of the evaporated fuel from the first canister 22 to the second canister 200 and to restrict backflow of the evaporated fuel from the second 200 canister to the first canister 22.

Fuel tank 20 receives fuel via a refueling line 116, which acts as a passageway between the fuel tank 20 and a refueling door 127 on an outer body of the vehicle. During a fuel tank refueling event, fuel may be pumped into the vehicle from an external source through refueling inlet 107 that is in fluid communication with refueling line 116. Fueling inlet 107 may be covered by a gas cap or may be capless. Vent valves 106A, 106B, 108 (described below in further details) may be open to recover fuel vapors (i.e., fuel that has been vaporized into a gaseous form) from a vapor space 104 within the fuel tank 20 during a refueling event where a refueling nozzle 131 is directing liquid fuel into the fuel tank via the refueling line 116. The fuel tank 20 may be configured to store both liquid fuel 115 and vaporized fuel 117. The refueling line 116 may be referred to as a fluid flow path that is configured to facilitate flow of liquid fuel into the fuel tank 20 from the refueling nozzle 131.

The fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to a controller 12. As depicted, fuel level sensor 106 may comprise a float connected to a variable resistor. Alternatively, other types of fuel level sensors may be used.

A fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system.

In some embodiments, engine 10 may be configured for selective deactivation. For example, engine 10 may be selectively deactivatable responsive to idle-stop conditions. Therein, responsive to any or all of idle-stop conditions being met, the engine 10 may be selectively deactivated by deactivating cylinder fuel injectors. As such, idle-stop conditions may be considered met if the engine 10 is combusting while a system battery (or energy storage device) is sufficiently charged, if auxiliary engine loads (e.g., air conditioning requests) are low, engine temperatures (intake temperature, catalyst temperature, coolant temperature, etc.) are within selected temperature ranges where further regulation is not required, and a driver requested torque or power demand is sufficiently low. In response to idle-stop conditions being met, the engine may be selectively and automatically deactivated via deactivation of fuel and spark. The engine may then start to spin to rest. Further, as elaborated herein, during conditions when fuel tank vacuum is elevated, the engine may be actively pulled-down, or deactivated, so as to enable the fuel tank vacuum to be vented to the deactivated engine.

Fuel vapors generated in fuel tank 20 may be routed to and stored in the first canister 22, via conduit 31, before being purged to engine intake 23. Additional fuel vapors may be routed to the second canister 200 when the first canister has no more capacity to store fuel vapors. Fuel tank 20 may include one or more vent valves for venting fuel vapors generated in the fuel tank 20 to first canister 22 via conduit 31. Conduit 31 may also be referred to as a fluid flow path that is configured to facilitate flow of the vaporized fuel between the fuel tank 20 and the first canister 22. Conduit 31 may also be in fluid commination with the refueling inlet 107 via vapor line 109. The one or more vent valves may be electronically or mechanically actuated valves and may include active vent valves (that is, valves with moving parts that are actuated open or close by a controller) or passive valves (that is, valves with no moving parts that are actuated open or close passively based on a tank fill level). In the depicted example, fuel tank 20 includes gas vent valves (GVV) 106A, 106B at either end of fuel tank 20 and a fuel level vent valve (FLVV) 108, all of which are passive vent valves. Each of the vent valves 106A, 106B, 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into first canister 22, preventing over-pressurizing of the fuel tank. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at the refueling nozzle 131 that is coupled to the fuel pump. The increase in pressure at the refueling nozzle 131 may then trip the refueling pump, stopping the fuel fill process automatically, and preventing overfilling.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves to open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may add substantial costs to the fuel system.

The first and second canisters 22, 200 are filled with an appropriate adsorbent for temporarily trapping fuel vapors (including vaporized hydrocarbons) via adsorption generated during fuel tank particularly during diurnal cycles. In one example, the adsorbent used is activated charcoal. When purging conditions are met, such as when the canisters 22, 200 are saturated, vapors stored in canisters 22, 200 may be purged via desorption to engine intake 23, specifically intake manifold 44, via purge line 28 by opening canister purge valve 112. The canister purge valve 112 is disposed between the second canister 200 and the engine 10 and is configured to direct the evaporated fuel from the first and second canisters 22, 200 to the engine when open. During purging conditions, while canister purge valve 112 is open, vacuum-actuated check valve 202 is forced opened due to engine intake vacuum. While a single canister 22 is shown between the fuel tank 20 and the check valve 202, it will be appreciated that fuel system 18 may include any number of canisters between the fuel tank 20 and the check valve 202. In one example, canister purge valve 112 may be a solenoid valve wherein opening or closing of the valve is performed via actuation of a canister purge solenoid. Furthermore, during purging conditions, vapors stored in the second canister 200 may additionally be purged to engine intake 23. While two canisters 22, 200 are shown, it will be appreciated that fuel system 18 may include any number of canisters.

First canister 22 includes a vent 27 (herein also referred to as a fresh air line) for routing gases out of the first canister 22 to the atmosphere when storing, or trapping, fuel vapors from fuel tank 20. Vent 27 may also allow fresh air to be drawn into first canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between first canister 22 and the atmosphere. The canister vent valve 114 may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve 114 may be opened to allow a flow of fresh air to strip the fuel vapors stored in the first canister 22. By closing canister vent valve 114, the fuel tank 20 may be isolated from the atmosphere.

One or more pressure sensors 120 may be coupled to fuel system 18 for providing an estimate of a fuel system pressure (e.g., the pressure of the liquid and/or evaporated fuel in the fuel system 18). The one or more pressure sensors 120 are configured to communicate the fuel system pressure to controller 12. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled to conduit 31 between the fuel tank and first canister 22, in alternate embodiments, the pressure sensor may be directly coupled to fuel tank 20 or first canister 22.

Fuel vapors released from first canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve 112 may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. Check valve 202 in purge line 28 may additionally prevent intake manifold pressure from flowing gases in the opposite direction of the purge flow. As such, the check valve 202 may compensate for conditions where canister purge valve control is not accurately timed or under conditions where the canister purge valve itself can be forced open by a high intake manifold pressure.

An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into first canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 114. As such, during the canister purging, the fuel tank vent valves 106A, 106B, and 108 are assumed to be open (though is some embodiments, some combination of valves may be closed). During this mode, vacuum generated by the intake manifold of the operating engine may be used to draw fresh air through vent 27 and through first canister 22 to purge the stored fuel vapors into intake manifold 44. In this mode, the purged fuel vapors from the first canister 22 are combusted in the engine. The purging may be continued until the stored fuel vapor amount in the canister is below a threshold. During purging, the learned vapor amount/concentration can be used to determine the amount of fuel vapors stored in the first canister 22, and then during a later portion of the purging operation (when the first canister 22 is sufficiently purged or empty), the learned vapor amount/concentration can be used to estimate a loading state of the first canister 22. For example, one or more oxygen sensors (not shown) may be coupled to the first canister 22 (e.g., downstream of the canister), or positioned in the engine intake and/or engine exhaust, to provide an estimate of a canister load (that is, an amount of fuel vapors stored in the first canister 22). Based on the canister load, and further based on engine operating conditions, such as engine speed-load conditions, a purge flow rate may be determined.

The vehicle 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas (air-to-fuel ratio) sensor 126 located upstream of the emission control device, exhaust temperature sensor 128, MAP sensor 118, and exhaust pressure sensor 129. The exhaust gas sensor 126 may more specifically be an oxygen sensor that measures an oxygen content within the exhaust gas output of the engine 10. The oxygen content is then communicated to the controller 12, which determines if the air-to-fuel ratio is rich, lean, or stoichiometric based on the measured oxygen content within the exhaust gas output. Other sensors such as additional pressure, temperature, air-to-fuel ratio, and composition sensors may be coupled to various locations in the vehicle 6. As another example, the actuators may include fuel injector 66, canister purge valve 112, canister vent valve 114, and throttle 62. The control system 14 may include controller 12. The controller 12 may receive input data from the various sensors, process the input data, and trigger the actuators in response to the processed input data based on instruction or code programmed therein corresponding to one or more routines.

While illustrated as one controller, the controller 12 may be part of a larger control system and may be controlled by various other controllers throughout the vehicle 6, such as a vehicle system controller (VSC). It should therefore be understood that the controller 12 and one or more other controllers can collectively be referred to as a "controller" that controls various actuators in response to signals from various sensors to control functions the vehicle 6 or vehicle subsystems. The controller 12 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 12 in controlling the vehicle 6 or vehicle subsystems.

Control logic or functions performed by the controller 12 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based vehicle, engine, and/or powertrain controller, such as controller 12. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the vehicle or its subsystems. The computer-readable storage devices or media may include one or more of a number of known physical devices which utilize electric, magnetic, and/or optical storage to keep executable instructions and associated calibration information, operating variables, and the like.

The second canister 200 and check valve 202 ensure that a cold start evacuation from the fuel evaporate system, which includes the first canister 22 and the second canister 200, does not result in excessive vapor inhalation into engine in order to protect against engine stalls. The second canister 200 is cleaned during a drive cycle and then the check valve 202 isolates the second-buffer canister 200 from further loading during a diurnal key off cycles. If check valve 202 is stuck open, then diurnal vapors can load the second canister 200 which is undesirable. If the check valve 202 is stuck closed, then opening the canister purge valve 112 results in a lack of vacuum response at pressure sensor 120. If the check valve 202 is stuck open, then diurnal and running loss vapors may load the second canister 200, which is undesirable as the leak detection diagnostic test is performed on a cold start and a loaded canister 200 can cause the engine 10 to stumble and even stall.

After a long key off cycle or a refuel event (daytime is preferable to cause diurnal cycle vapors to generate and fill up the fuel evaporate system), a diagnostic is enabled. A refuel event followed by a short drive will fill the canister and keep it full. A vehicle soak in a hot climate will also fill the canister. If the check valve 202 is stuck open, then diurnal vapors would have loaded both the first and second canisters. If check valve 202 is functional, then diurnal vapors will only have loaded the first canister 22 and not the second-buffer canister 200. In order to diagnose if the check valve 202 is stuck open, the oxygen sensor 126 is utilized to monitor the air-to-fuel ratio of the engine 10. On a cold start and after the fuel system control enters closed loop (catalyst is lit off), the sensor 126 is monitored for a stoichiometric condition. At this point, the purge valve 112 is opened. Since the second canister 200 should be clear of fuel vapors, the sensor 126 should register a lean air-to-fuel ratio for a period of time as fresh air displaces the fuel vapors from the first canister 22 into the second-buffer canister 200. The fuel vapors should continue migrating from the first canister 22 into the second canister 200 until they breakthrough and enter the intake manifold. At this point the sensor 126 should register a rich air-to-fuel ratio. Hence the "transport delay" for migrating vapors from the first canister 22 during a purging operation into the clean second canister 200.

A time constant of sensor 126 lean excursion is observable with a functioning check valve 202 that seals during a diurnal key off cycle. This time constant is a measurable response for the diagnostic. If the check valve 202 is stuck open, then the sensor 126 response switches rich almost immediately when the purge valve 112 is opened, since a stuck open check valve 202 would allow diurnal vapors to load the second canister 200 (i.e., there is a lack of lean excursion). If the check valve is stuck closed, then the pressure sensor 120 will not register a pressure vacuum (i.e., a pressure that is lower than the ambient atmospheric pressure) during a standard evaporate leak detection test or routine (e.g., evaporate leak diagnostic for the 0.04" leak). Such a diagnostic improves engine performance during cold start evaporate leak diagnostic runs by ensuring the special buffer canister (e.g., second canister 200) is clean and not loaded with diurnal vapors, which reduces evaporative fuel emissions.

Figure 2:
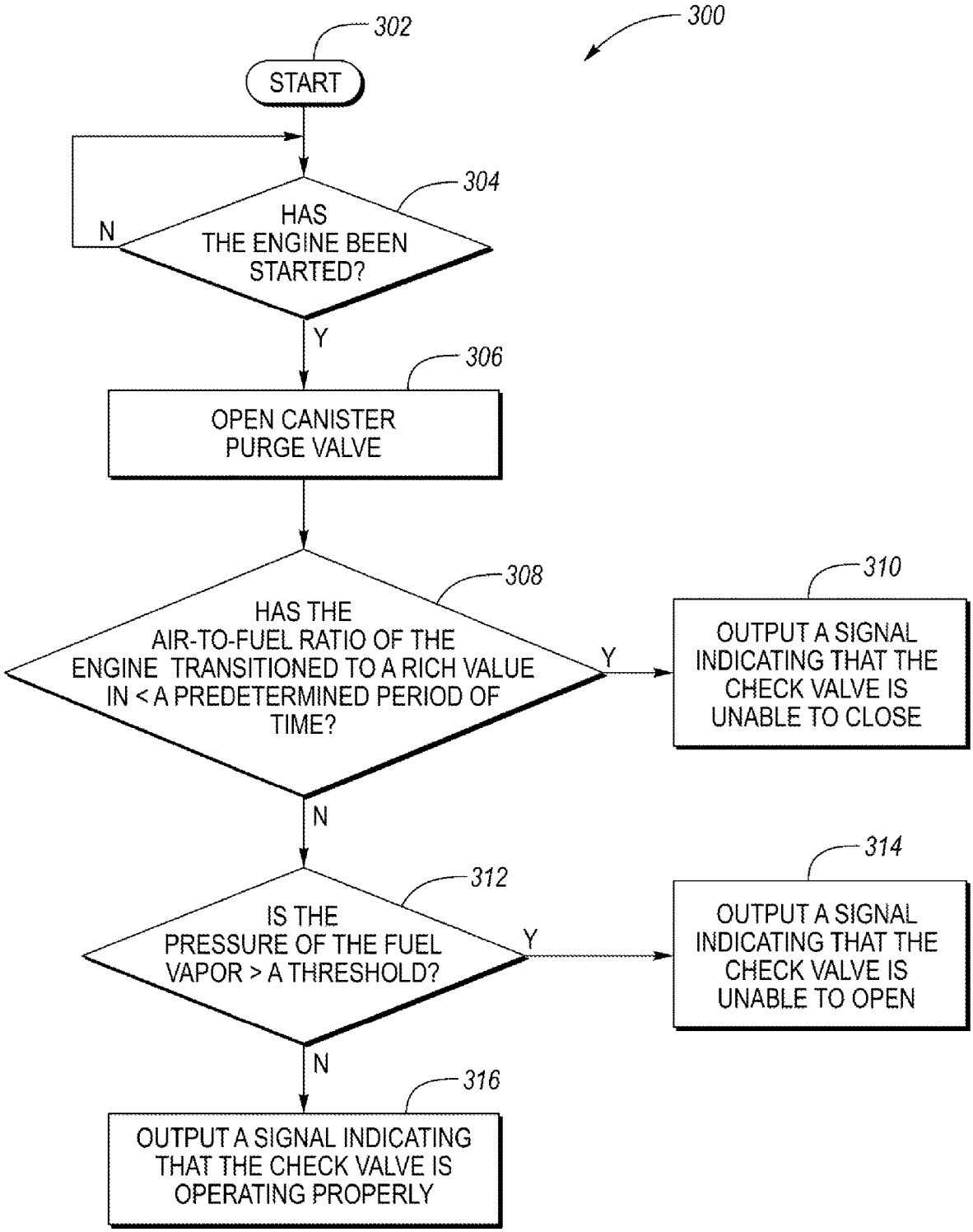
FIG. 2 is a flowchart illustrating a method for determining the operability of a check valve of a vehicle evaporative emissions system.

Referring to FIG. 2, a flowchart of a diagnostic test or method 300 for determining the operability of the check valve 202 is illustrated. The method 300 may be stored as control logic and/or an algorithm within the controller 12. The method 300 is initiated at start block 302. Next, the method 300 moves on to block 204 where it is determined if the engine 10 has been started. More specifically, block 204 may determine if the engine 10 has been started after sufficient period of time such that the engine 10 has cooled down to the ambient temperature or approximately the ambient temperature. Such a start where the engine 10 has cooled down to the ambient temperature or approximately the ambient temperature may be referred to as a cold start.

The controller 12 may determine if the engine start is a cold start by measuring the temperature of the engine 10 or the coolant within the engine 10. If the temperate is below a specified threshold, the start may be deemed to be cold start. If the temperate is above the specified threshold, the start may be deemed to not be cold start. Alternatively, the controller 12 may determine if the engine start is cold start based on whether or not a predetermined soak time has elapsed. For example, if the engine 10 was shutdown for a period of time (i.e., the time period between the last shutdown of the engine 10 and the current engine start) that exceeds the predetermined soak time, the start may be deemed to be cold start. If the engine 10 was shutdown for a period of time that did not exceed the predetermined soak time, the start may be deemed to not be cold start.

If it is determined that the engine has not been started, or alternatively that the engine start is not a cold start, the method 300 either ends or recycles back to the beginning of block 304. If it is determined that the engine has been started, or alternatively that the engine start is a cold start, the method 300 moves on to block 306 where the canister purge valve 112 is opened. The canister purge valve 112 being opened after an engine start is illustrated as occurring at time $t_1$ in FIGS. 3-5. The engine start is illustrated as occurring at time to in FIGS. 3-5. It should also be noted that as the method 300 transitions from block 304 to block 306, the controller 12 will be monitoring the pressure of the evaporated fuel within the fuel system 18 via pressure sensor 120 and will be constantly monitoring and determining an air-to-fuel ratio of the engine 10 based on the oxygen content within exhaust output of the engine that is being measured via exhaust gas sensor 126. After the engine 10 has been started and the canister purge valve 112 has been opened the method 300 moves on to block 308.

At block 308, it is determined if the air-to-fuel ratio of the engine 10 has transitioned to a rich value (i.e., an air-to-fuel ratio that is less than the stoichiometric air-to-fuel ratio, which is approximately 14.7:1) in less than a threshold or predetermined period of time after the cold engine start. If it is determined that the air-to-fuel ratio of the engine 10 has transitioned to a rich value in less than the predetermined period of time after the cold engine start, the method 300 moves on to block 310 where the controller 12 outputs a signal, or more specifically a fault signal, indicating that the check valve 202 is unable to close (i.e., the check valve 202 is stuck in the open position). The signal may be transmitted to a vehicle instrument panel, which may then communicate the operating condition of the check valve 202 to the operator in the form of an indicator light and/or a text-based message.

Figure 3:
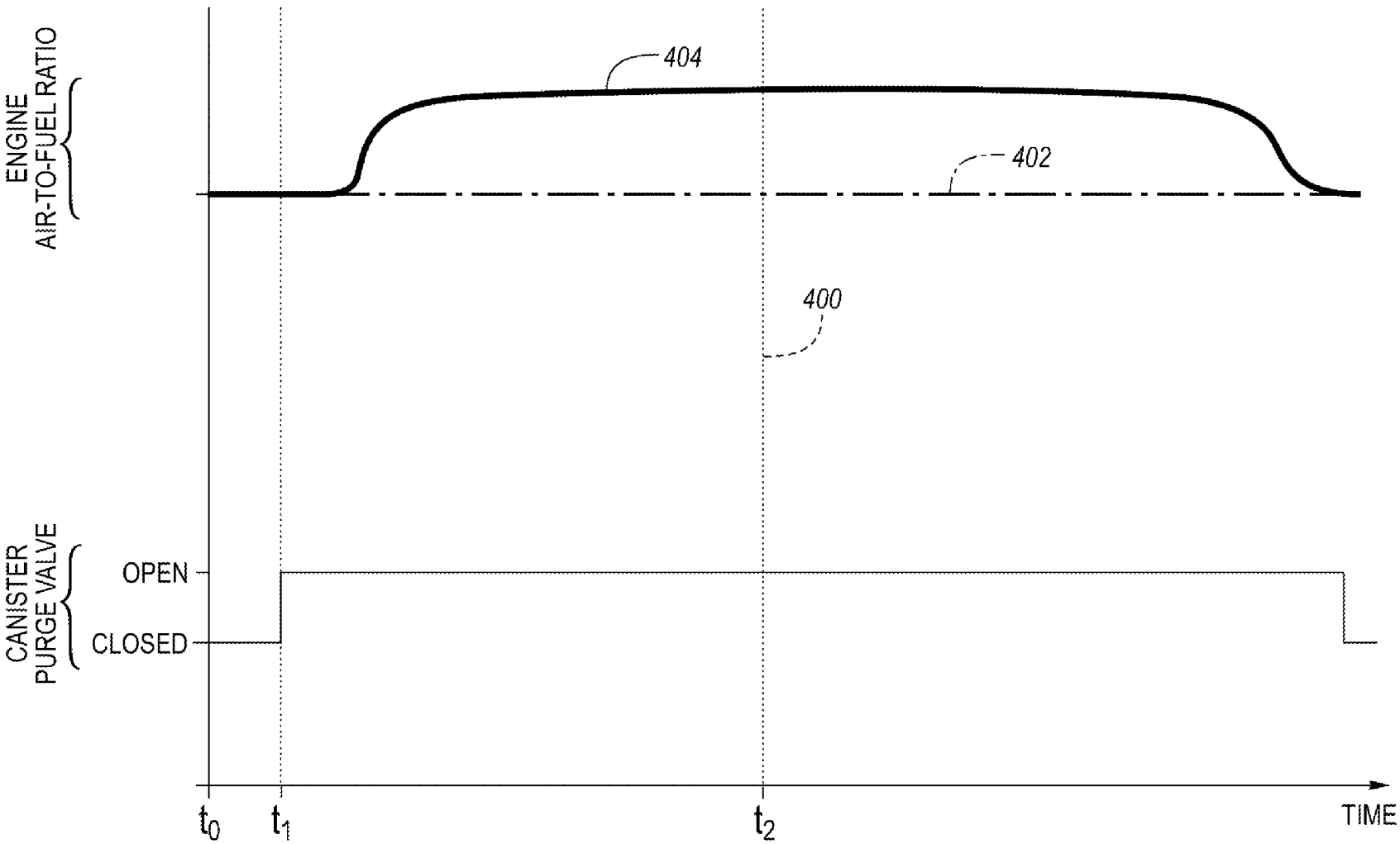
FIG. 3 is a series of graphs illustrating the conditions of the various vehicle components when the check valve is unable to close.
Figure 5:
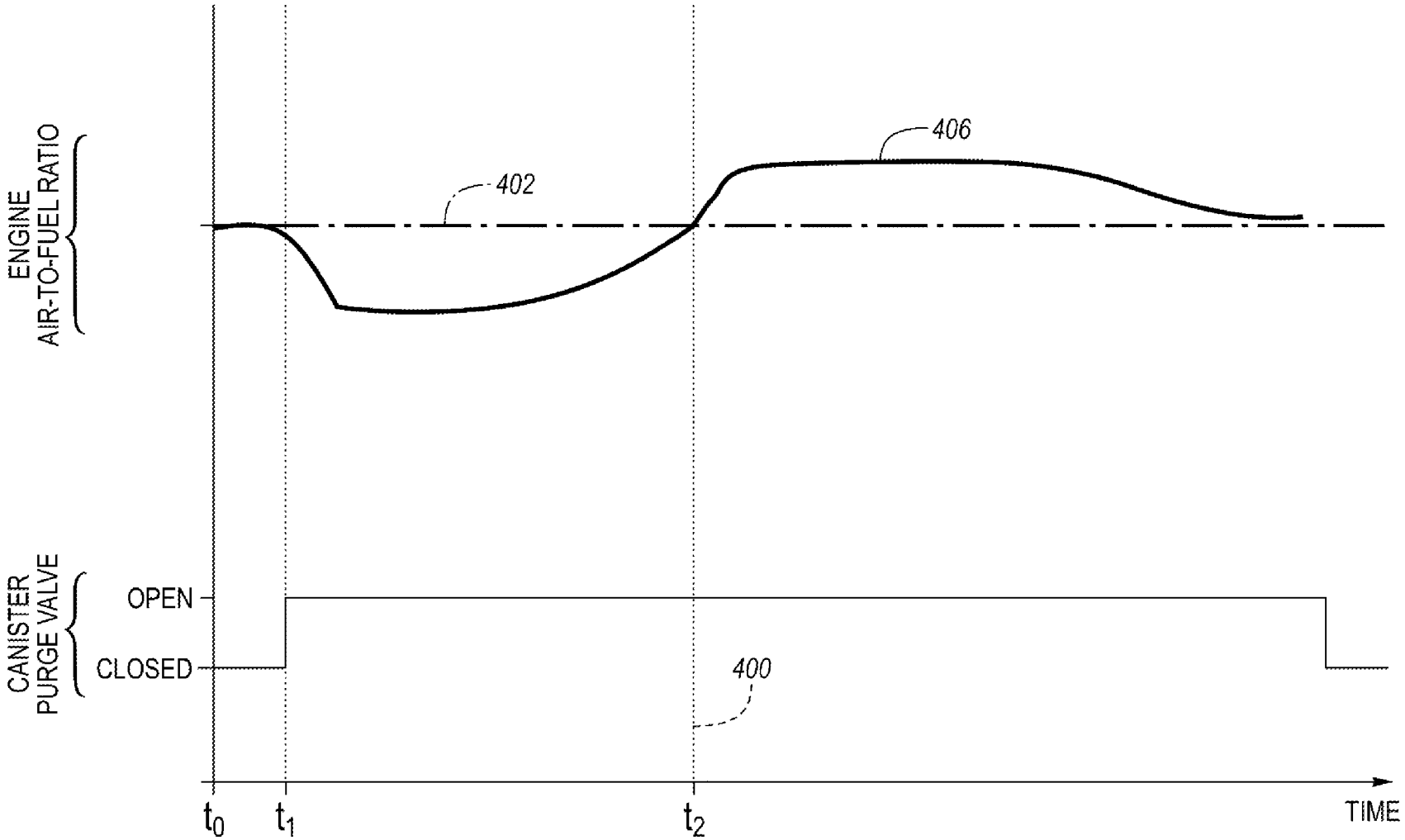
FIG. 5 is a series of graphs illustrating the conditions of various vehicle components when the check valve is operating properly.

Vertical line 400 in FIGS. 3 and 5, occurring at time $t_2$, illustrates the threshold predetermined period of time after the cold engine start and line 402 in FIGS. 3 and 5 illustrates the stoichiometric air-to-fuel ratio. Any value above line 402 is a rich air-to-fuel ratio and any value below line 402 is a lean air-to-fuel ratio (i.e., an air-to-fuel ratio that is greater than the stoichiometric air-to-fuel ratio). Line 404 in FIG. 3 illustrates a scenario where the air-to-fuel ratio of the engine 10 transitions to a rich value in less the predetermined period of time at line 402. The transition may be either from a lean value or the stoichiometric value. Therefore, under the scenario in FIG. 3, the method 300 would have transitioned to block 310 and the controller 12 would have output the signal that the check valve 202 is unable to close.

Returning to block 308, if it is determined that the air-to-fuel ratio of the engine 10 has not transitioned to a rich value in less than a predetermined period of time after the cold engine start, the method 300 moves on to block 312. However, more specifically, at block 308, the method 300 may be monitoring to see if the air-to-fuel ratio of the engine 10 first operates under a lean air-to-fuel ratio condition after the cold engine start and then transitions to a rich air-to-fuel ratio condition at or after the predetermined period of time (i.e., line 400). If such a transitional scenario is present, the method 300 may then transition to block 312. Line 406 in FIG. 5 illustrates a scenario where the air-to-fuel ratio first operates under a lean air-to-fuel ratio condition after the cold engine start and then transitions to a rich air-to-fuel ratio condition at or after the predetermined period of time.

At block 312 is it determined of the pressure of the fuel vapor within the fuel system 18 (i.e., the pressure measured via pressure sensor 120) is greater than a threshold pressure after the cold engine start. The threshold pressure may correspond to a predetermined value that is less than atmospheric pressure and therefore may be referred to as a vacuum pressure relative to the ambient atmospheric pressure. The system should see such a vacuum pressure if the engine 10 is on and the check valve is open since the engine 10 will be generating a lower pressure within the intake manifold to draw in air and fuel. The threshold may more specifically correspond a target vacuum during vehicle operating conditions.

Figure 4:
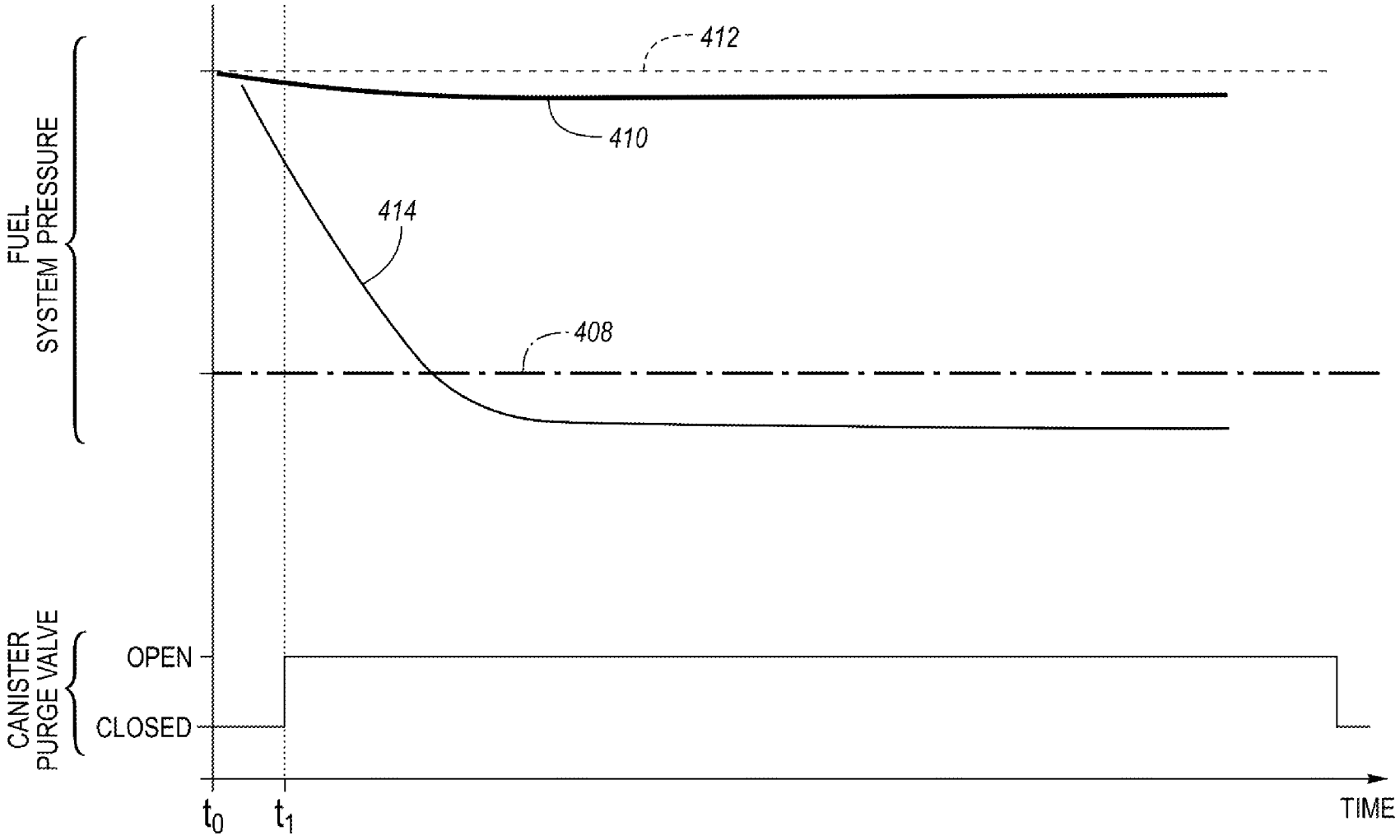
FIG. 4 is a series of graphs illustrating the conditions of the various vehicle components when the check valve is unable to open.

If the pressure is greater than the threshold pressure, the method 300 moves on to block 314 where the controller 12 outputs a signal, or more specifically a fault signal, indicating that the check valve 202 is unable to open (i.e., the check valve 202 is stuck in the closed position). The signal may be transmitted to a vehicle instrument panel, which may then communicate the operating condition of the check valve 202 to the operator in the form of an indicator light and/or a text-based message. Line 408 in FIG. 4 illustrates the threshold pressure. Line 410 in FIG. 4 illustrates a scenario where the pressure of the fuel vapor within the fuel system slightly drops to less than an atmospheric pressure (i.e., line 412) after the cold engine start but remains above the threshold pressure. Therefore, under the scenario illustrated by line 410 in FIG. 4, the method 300 would have transitioned to block 314 and the controller 12 would have output the signal that the check valve 202 is unable to open.

Returning to block 312, if it is determined that the pressure is not greater than the threshold pressure, the method 300 moves on to block 316 where the controller 12 outputs a signal indicating that the check valve 202 is operating properly. The signal may be transmitted to a vehicle instrument panel, which may then communicate the operating condition of the check valve 202 to the operator in the form of an indicator light and/or a text-based message. Line 414 in FIG. 4 illustrates a scenario where the pressure of the fuel vapor within the fuel system drops to less the threshold pressure (i.e., line 408) after the cold engine start. Therefore, under the scenario illustrated by line 414 in FIG. 4, the method 300 would have transitioned to block 316 and the controller 12 would have output the signal that the check valve 202 is operating properly.

It should be understood that the flowchart in FIG. 2 is for illustrative purposes only and that the method 300 should not be construed as limited to the flowchart in FIG. 2. Some of the steps of the method 300 may be rearranged while others may be omitted entirely.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A vehicle comprising:

an engine;

a fuel tank configured to store fuel;

first and second canisters, each configured to receive evaporated fuel from the fuel tank, store the evaporated fuel, and deliver the evaporated fuel to the engine, wherein the second canister is disposed between the first canister and the engine;

a purge valve disposed between the second canister and the engine, wherein the purge valve is configured to direct the evaporated fuel from the first and second canisters to the engine when open;

a check valve disposed between the first and second canisters and configured to restrict backflow of the evaporated fuel from the second canister toward the first canister; and a controller programmed to, in response to detecting a rich value of an air-to-fuel ratio of the engine in less than a predetermined period of time after an engine start, output a fault signal indicating that the check valve is unable to close, in response to the engine start, open the purge valve, in response to the pressure of the evaporated fuel within the fuel tank decreasing from a first value to a second value that is greater than a threshold in response to opening the purge valve and while the purge valve is open, output a signal that the check valve is unable to open, and in response to (i) detecting a change in the air-to-fuel ratio from a lean value to the rich value after the predetermined period of time has expired and (ii) the pressure of the evaporated fuel within the fuel tank decreasing from the first value to a third value that is less than the threshold in response to opening the purge valve and while the purge valve is open, output a signal indicating that the check valve is operating properly.

2. The vehicle of claim 1, wherein the pressure of the evaporated fuel corresponds to a pressure within the fuel tank, the first canister, or a conduit that establishes fluid communication between the fuel tank and the first canister.

3. The vehicle of claim 1, wherein the threshold corresponds to a predetermined value that is less than atmospheric pressure.

4. The vehicle of claim 1, wherein the engine start is a cold start corresponding to the engine being started after being shutdown for a predetermined soak time.

5. A vehicle comprising:

an engine configured to propel the vehicle;

an oxygen sensor configured to measure an oxygen content within an exhaust output of the engine;

a fuel tank configured to store fuel;

a primary canister configured to receive evaporated fuel from the fuel tank, store the evaporated fuel via adsorption, and deliver the evaporated fuel to the engine via desorption;

a secondary canister disposed between the primary canister and the engine, configured to receive the evaporated fuel from the fuel tank, store the evaporated fuel via adsorption, and deliver the evaporated fuel to the engine via desorption;

a check valve disposed between the primary and secondary canisters and configured to facilitate flow of the evaporated fuel from the primary canister to the secondary canister and to restrict flow of the evaporated fuel from the secondary canister to the primary canister;

a pressure sensor disposed between the primary canister and the fuel tank and configured to measure a pressure of the evaporated fuel at the fuel tank;

a purge valve disposed between the secondary canister and the engine, wherein the purge valve is configured to direct the evaporated fuel from the primary and secondary canisters to the engine when open; and a controller programmed to, determine an air-to-fuel ratio of the engine based on the measured oxygen content within the exhaust output of the engine, in response to a cold engine start and the air-to-fuel ratio transitioning to a rich value in less than a predetermined period of time after the cold engine start, output a signal that the check valve is unable to close, in response to the cold engine start, open the purge valve, in response to (i) the cold engine start and (ii) the pressure sensor registering a pressure value that decreases but remains greater than a threshold in response to opening the purge valve and while the purge value is open, output a signal that the check valve is unable to open, and in response to the (i) air-to-fuel ratio transitioning from a lean value to the rich value after the predetermined period of time has expired, and (ii) the pressure sensor registering the pressure value decreasing to less than the threshold in response to opening the purge valve and while the purge valve is open, output a signal indicating that the check valve is operating properly.

6. The vehicle of claim 5, wherein the threshold corresponds to a predetermined value that is less than atmospheric pressure.

7. The vehicle of claim 5, wherein the cold engine start corresponds to the engine being started after being shutdown for a predetermined soak time.

8. A vehicle comprising:

an engine;

a fuel tank configured to store fuel;

a primary canister configured to receive and store evaporated fuel from the fuel tank;

a buffer canister configured to receive and store the evaporated fuel from the fuel tank, wherein the buffer canister is disposed between the primary canister and the engine;

a purge valve disposed between the buffer canister and the engine, wherein the purge valve is configured to direct the evaporated fuel from the primary and buffer canisters to the engine when open;

a check valve disposed between the primary and buffer canisters and configured to restrict backflow of the evaporated fuel from the engine and the buffer canister toward the primary canister; and a controller programmed to, in response to an engine start, open the purge valve and monitor a pressure of the evaporated fuel, and in response to the pressure of the evaporated fuel within the fuel tank decreasing from a first value to a second value that is greater than a threshold in response to opening the purge valve and while the purge valve is open, output a signal that the check valve is unable to open, in response to detecting a rich air-to-fuel ratio of the engine in less than a predetermined period of time after the engine start, output a signal that the check valve is unable to close, and in response to (i) the air-to-fuel ratio transitioning from a lean value to the rich value after the predetermined period of time has expired and (ii) the pressure of the evaporated fuel within the fuel tank decreasing from the first value to a third value that is less than the threshold in response to opening the purge valve and while the purge valve is open, output a signal indicating that the check valve is operating properly.

9. The vehicle of claim 8, wherein the threshold corresponds to a predetermined value that is less than atmospheric pressure.

10. The vehicle of claim 8, wherein the engine start is a cold start corresponding to the engine being started after being shutdown for a predetermined soak time.

11. The vehicle of claim 8 further comprising a pressure sensor that is configured to measure the pressure of the evaporated fuel and communicate the pressure of the evaporated fuel to the controller.

12. The vehicle of claim 11, wherein the pressure sensor is disposed within the fuel tank, the primary canister, or a conduit that establishes fluid communication between fuel tank and the primary canister.

* * * * *